US005577925A

United States Patent [19]

Schnatzmeyer et al.

[11] Patent Number: 5,577,925

[45] Date of Patent: Nov. 26, 1996

[54] CONCENTRIC WET CONNECTOR SYSTEM

[75] Inventors: Mark A. Schnatzmeyer, Lewisville; Pat M. White, Carrollton, both of Tex.

[73] Assignee: Halliburton Company, Dallas, Tex.

[21] Appl. No.: 493,512

[22] Filed: Jun. 22, 1995

Related U.S. Application Data

[63] Continuation of Ser. No. 231,533, Apr. 22, 1994, abandoned, which is a continuation of Ser. No. 964,509, Oct. 21, 1992, abandoned.

[51] Int. Cl.[6] ..... E21B 7/12; F16L 41/02

[52] U.S. Cl. ..... 439/191; 285/131

[58] Field of Search ..... 439/190–195; 166/65.1, 66, 66.4, 66.5, 319; 175/104; 285/131

[56] References Cited

U.S. PATENT DOCUMENTS

| | | | |
|---|---|---|---|
| 3,339,632 | 9/1967 | Lewis | 439/195 |
| 3,626,969 | 12/1971 | Garrett | 166/319 |
| 3,696,332 | 10/1972 | Dickson, Jr. | 175/104 |
| 4,126,183 | 11/1978 | Walker | 285/131 |
| 4,445,734 | 5/1984 | Cunningham | 439/194 |
| 4,781,607 | 11/1988 | Rumbaugh | 439/191 |
| 4,921,438 | 5/1990 | Godfrey et al. | 439/190 |
| 4,997,384 | 3/1991 | Godfrey et al. | 439/190 |
| 5,052,941 | 10/1991 | Hernandez-Marti | 166/65.1 |
| 5,058,683 | 10/1991 | Godfrey et al. | 166/65.1 |

OTHER PUBLICATIONS

"Annular Safety Valve System Design" by C. E. Robinson and C. Parker, Presented at Subsea 91 International Conference Dec. 4–5, 1991, 8 pp. plus drawings.

*Primary Examiner*—Neil Abrams

*Attorney, Agent, or Firm*—William M. Imwalle; Paul I. Herman

[57] ABSTRACT

A concentric wet connector system useful for connecting, disconnecting and reconnecting small diameter fluid lines (40, 42, 44) and electrical lines (46) downhole in oil and gas wells, the system comprising first and second slidably engageable well tubulars (32, 38) coaxially disposed around a longitudinal bore, each well tubular having a circumferentially extending wall section containing at least one auxiliary conduit leading to a connector port 64 paired and communicating with a connector port 66 of the other tubular. The connector ports in each well tubular are preferably spaced apart both circumferentially and longitudinally. The connector ports of each respective pair are preferably disposed at substantially the same well depth whenever the two well tubulars are fully engaged, and communication between the connector ports of each pair is preferably established by means of an annular flow channel 74 (for fluid lines) or an annular recess with an electrically conductive band 104 (for electrical control wires) to avoid the need for specific rotational alignment between the well tubulars. Use of the system for connecting fluid lines and/or electrical control wires to well tools and monitoring equipment suspended below a production packer and annular safety valve in a well bore is also disclosed. The tubulars are also locatable by shear collar (150) in a position short of full engagement (FIG. 8) in which ports (64, 140) on the inner tubular (32) are both open to annular channel (74) to permit flushing of these ports.

18 Claims, 14 Drawing Sheets

CONCENTRIC WET CONNECTOR SYSTEM

This application is a continuation of parent application Ser. No. 08/231,533, filed Apr. 22, 1994 and now abandoned, which in turn was a continuation its parent application Ser. No. 07/964,509, filed Oct. 21, 1992, and now abandoned.

BACKGROUND OF THE INVENTION

1. Field of the Invention

This invention relates to apparatus useful for connecting, disconnecting and reconnecting small diameter fluid and electrical lines used in downhole applications in oil and gas wells. More particularly, the invention relates to a concentric wet connector system useful for establishing or reestablishing fluid or electrical communication between the lower end of one or more small diameter conduits extending from the surface to a connector disposed below the surface and the upper end of one or more other small diameter conduits extending downwardly from the connector to a point of use disposed below the connector.

2. Description of Related Art

The use of small diameter conduits for supplying control fluids to downhole tools, for delivering injection fluids to downhole formations, and for communicating electrical signals to and from downhole instrumentation is well known. Such conduits are typically part of a production string that is run into the casing of oil and gas wells. At some points in the production string, the conduits are external to the production tubing or well tools. At other points, the conduits may pass downward through the tools or be connected by fittings to ports, channels or small diameter bores within the well tubulars or tools. In many wells, the production string may desirably include a plurality of such small diameter conduits for various purposes.

During workover operations, it is frequently desirable or necessary to break a connection in a production string, thereby permitting a portion of the string to be withdrawn from the well bore while another portion of the string remains suspended from a tool such as a packer or hanger installed at some point below the surface. Whenever the connection that is broken is spanned by one or more control lines, injection lines or electrical lines, it may be impossible to later reestablish the integrity of the lines unless means are provided in the affected tools for disconnecting and reconnecting them. Because the point where the desired reconnection is to occur may be exposed to contact by liquid hydrocarbons or other fluids present in the well, the means for making the connection should not be adversely affected by the presence of such fluids.

Wet connectors for use in oil and gas wells have previously been disclosed, for example, in U.S. Pat. Nos. 4,921,438, 4,997,384 and 5,058,683. Conventional wet connectors have typically been of the nipple and socket type, and have been installed, for example, in side pocket mandrels using kickover tools lowered by wireline through the production tubing. Wet connector means are needed, however, that are adapted to easily and simultaneously disconnect and reconnect a plurality of control lines and/or electrical lines without the use of special tools, without the need for rotational alignment between parts being reconnected, and without impeding fluid flow through the production tubing.

SUMMARY OF THE INVENTION

According to a preferred embodiment of the invention, a wet connector system is provided that comprises first and second slidably engageable well tubulars, each having a circumferentially extending wall section containing at least one connector port paired and communicating with a connector port of the other tubular.

According to another preferred embodiment of the invention, a wet connector system is provided that comprises first and second slidably engageable well tubulars, each having a circumferentially extending wall section containing a plurality of circumferentially and longitudinally spaced wet connector ports, each connector port being paired and communicating with a wet connector port of the other tubular.

According to another preferred embodiment of the invention, a concentric wet connector system is provided that comprises a centrally disposed, longitudinal bore which does not impede fluid flow through the wet connector assembly.

According to another preferred embodiment of the invention, a wet connector system is provided that can be used in downhole service in an oil and gas well to connect, disconnect or reconnect simultaneously a plurality of circumferentially spaced, small diameter conduits attached to well tubulars. The system of the invention can be used for making and breaking connections in both fluid lines and electrical control wires. Each small diameter conduit to be connected or disconnected preferably comprises a cooperating pair of connector ports, each of which is disposed in the wall of one of two slidably engageable well tubulars. The connector ports in each well tubular are preferably spaced apart both circumferentially and longitudinally. The connector ports of each respective pair are preferably disposed at substantially the same well depth whenever the two well tubulars are fully engaged. Communication between the connector ports of each pair is preferably established by means of an annular flow channel (for fluid lines) and an annular, electrically conductive band (for electrical control wires) to eliminate the need for specific rotational alignment between the well tubulars in connecting the small diameter conduits.

According to another preferred embodiment of the invention, the connector ports, annular flow channels and recesses and packing therebetween are preferably spaced so that the flow channels and recesses can be purged prior to fully engaging the well tubulars and prior to reestablishing the respective fluid and/or electrical connection.

The wet connector system of the invention is particularly useful for connecting fluid lines and/or electrical control wires to well tools and monitoring equipment suspended below a production packer and annular safety valve in a well bore.

BRIEF DESCRIPTION OF THE DRAWINGS

The apparatus of the invention is further described and explained in relation to the following figures of the drawings wherein.

DESCRIPTION OF THE PREFERRED EMBODIMENTS

Although wet connector system 35 of the invention is described herein in relation to its preferred use with a TRSV and ASV installation, it will be appreciated upon reading the disclosure that the apparatus of the invention can also be used beneficially in other applications and with other types of valves and well tools.

Figure 1:
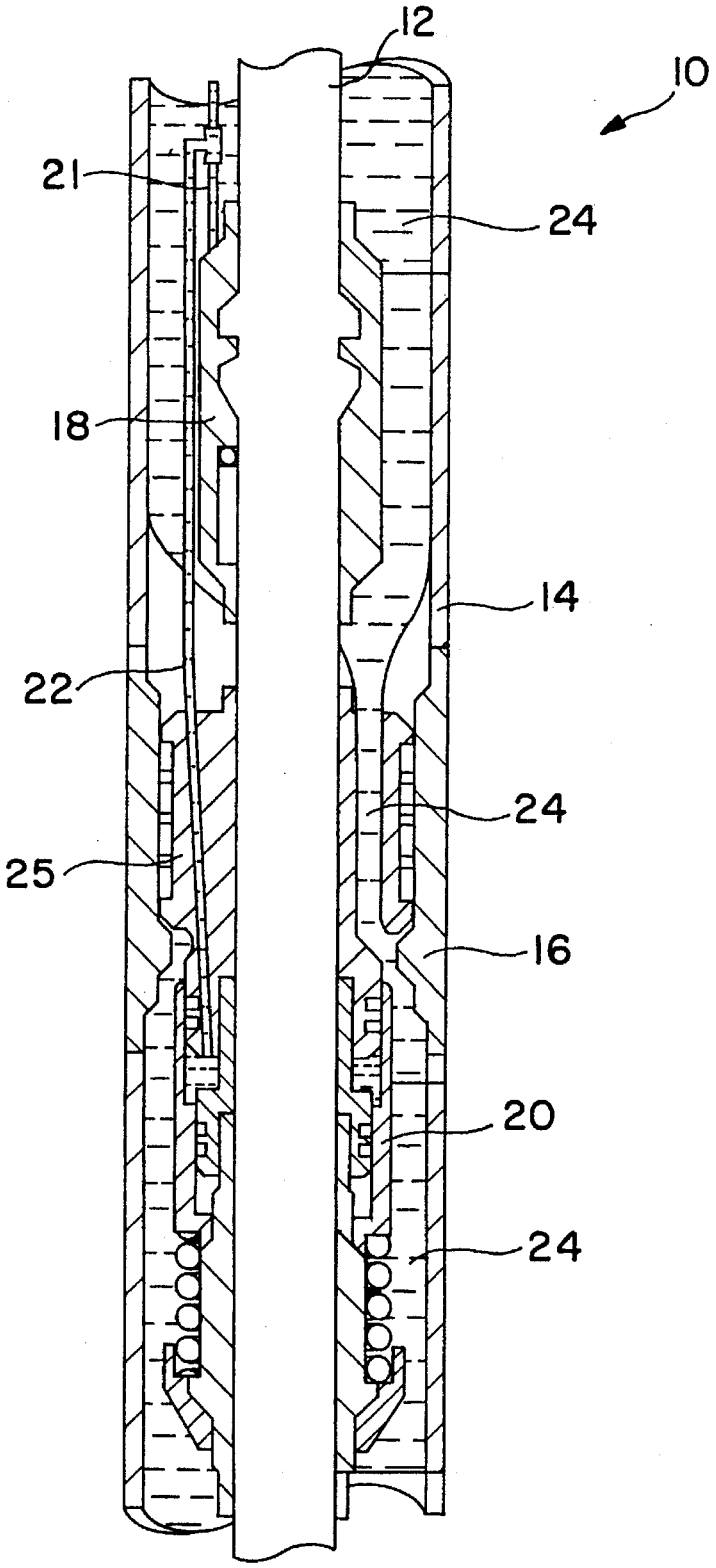
FIG. 1 PRIOR ART
FIG. 1 is a schematic elevation view, partially in section, of a prior art tubing retrievable safety valve and annular safety valve installed inside casing in a well bore.

When producing from oil and gas wells, tubing retrievable safety valves and annular safety valves are commonly utilized to control downhole pressures and prevent accidents that might otherwise occur. Referring to FIG. 1, a conventional, prior art installation 10 is shown in which production tubing 12 is disposed inside casing 14 and inside packer 25, which engages polished casing nipple 16. Fluid flow through tubing 12 is controlled by tubing retrievable safety valve (TRSV) 18, and annular fluid flow 24 is controlled by annular safety valve (ASV) 20. Valves 18, 20 remain open so long as hydraulic pressure is exerted on the valves through control lines 21, 22. ASV 20 is typically a surface-controlled, normally closed, single line valve designed for low pressure, shallow depth applications where it is desirable to flow both the tubing and annulus; to vent or monitor gas pressure in the annulus while producing through the tubing; or to inject fluid or gas into the annulus while producing through the tubing. A TRSV is often run in conjunction with an ASV to control either tubing flow or injection.

Just as TRSV 18 cuts off flow in production tubing 12, ASV 20 together with ASV packer 25 cuts off flow through the annulus between tubing 12 and casing 14 below packer 25. In a typical application such as a gas lift injection well, packer 25 is set at a relatively shallow depth of about 1000 to 2000 feet, and gas is injected down the annulus to gas lift valves (not shown) at depths such as 10,000 to 12,000 feet. By suspending the weight of the production string from the ASV packer 25, only that portion of the production tubing above the packer is suspended from the wellhead.

It is often desirable to have additional small diameter conduits extending downhole past the TRSV, ASV and packer for use in injecting chemicals or for use in routing electrical control wires to downhole tools or instrumentation for real time monitoring of pressure, temperature, or both. Whenever retrieval of the TRSV or ASV is needed for routine maintenance or other purposes, that portion of the tubing string disposed below the packer is often left downhole to avoid tripping the whole production string. When this occurs, control lines such as fluid lines and electrical control wires extending downhole must be disconnected or parted. Desirably, these lines should be disconnected in such manner that they can later be reconnected when the TRSV and ASV are run back into the well.

Figure 2:
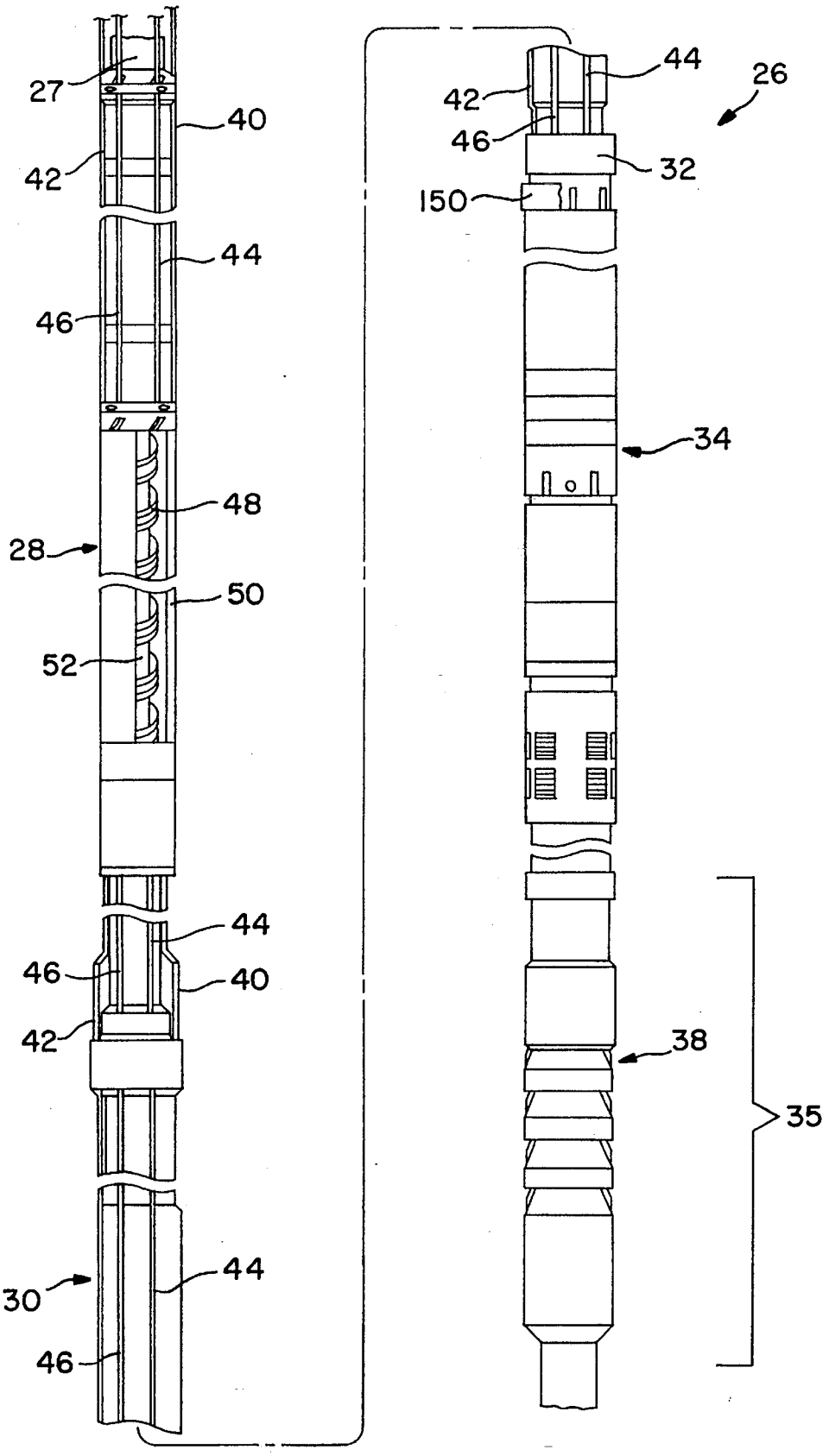
FIG. 2 is a simplified elevation view, partially in section and partially broken away, of that portion of a production string comprising a travel joint, a tubing retrievable safety valve, and the wet connector system of the invention.

FIG. 2 depicts in simplified form an installation utilizing the apparatus of the present invention with a plurality of circumferentially spaced control lines, chemical injection lines and electrical control wires. Referring to FIG. 2, TRSV control line 40 supplies hydraulic pressure to TRSV 30. Similarly, ASV control line 42 supplies hydraulic pressure to an annular safety valve (not visible inside packer 34) attached to wet connector seal unit 32. The structure and operation of wet connector seal unit 32, which is inserted downward through packer 34 and into concentric wet connector assembly 38 of wet connector system 35, is discussed in more detail below. Chemical injection line 44 and electrical control line 46 are attached to wet connector seal unit 32 and likewise extend downwardly through packer 34 into concentric wet connector assembly 38. Auxiliary conduits such as chemical injection line 44 and electrical control line 46 are sometimes referred to herein as "small diameter conduits" because they have diameters that are typically less than the diameter of the tubing string to which they are attached.

It should be understood that travel joint 28 and TRSV 30 are shown in FIG. 2 only as exemplary elements of one preferred installation and application for wet connector seal unit 32 and wet connector assembly 38 of the invention. Travel joint 28 desirably comprises inner mandrel 52 slidably disposed inside outer housing 50, and helical coils 48 are preferably provided in lines 42, 44, 46, 48 to allow for adjustment in tubing length due to changes in temperature and pressure encountered downhole.

Although only one chemical injection line 44 and one electrical control line 46 are visible in FIG. 2, it should also be understood that other chemical injection lines and electrical cables can also be circumferentially spaced around tubing 27, travel joint 28, TRSV 30 and wet connector seal unit 32. Thus, for example, two chemical injection lines and two electrical control wires are visible and discussed below in relation to FIGS. 3A–C, in which circumferentially spaced sections are successively broken away to facilitate two dimensional illustration.

Figure 3A:
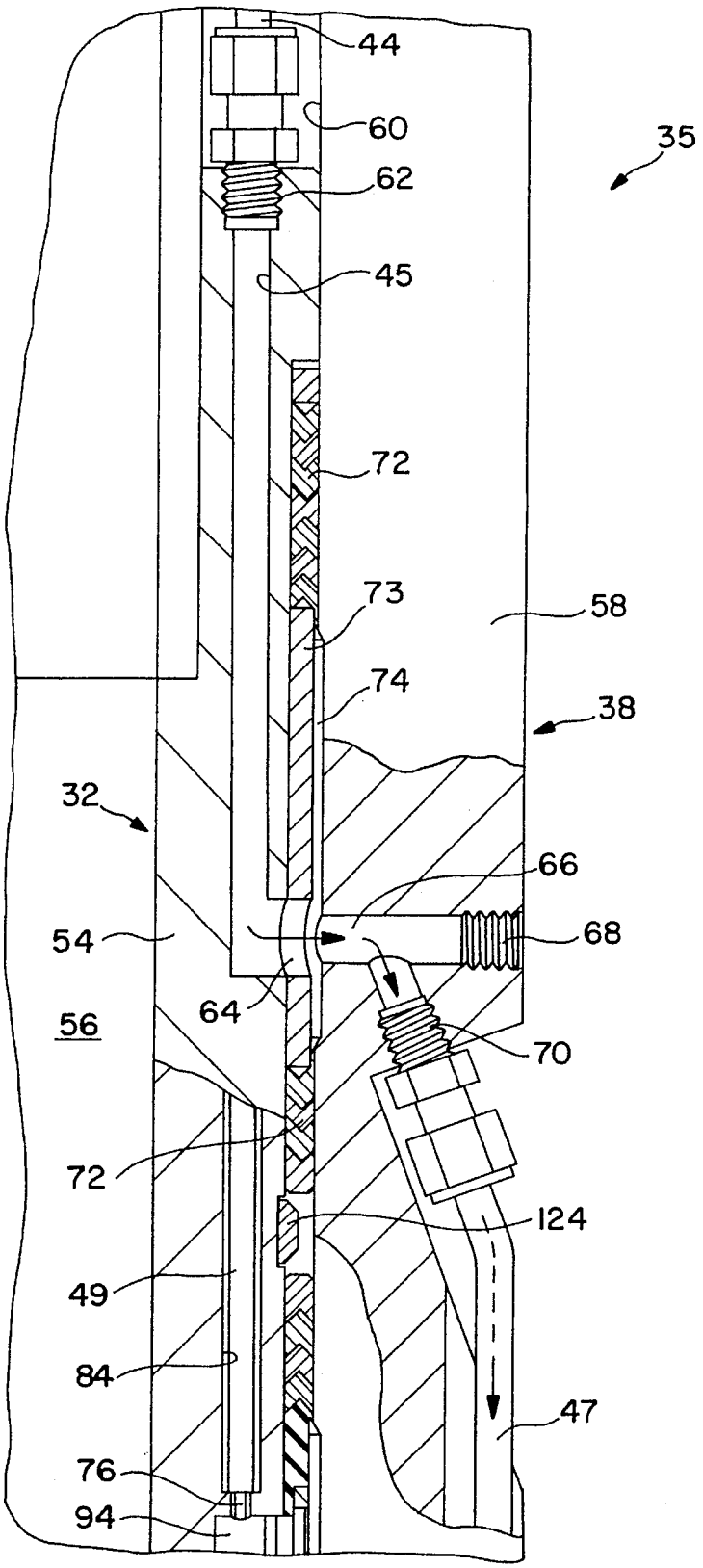
FIGS. 3A–3D, taken together, depict an enlarged elevation view, partially in section and partially broken away, of those portions of the wet connector seal unit from FIG. 2 that embody the concentric wet connector assembly of the invention as fully seated inside a packer and polished bore receptacle with two fluid (chemical injection) lines and two electrical control wires fully connected.
Figure 3B:
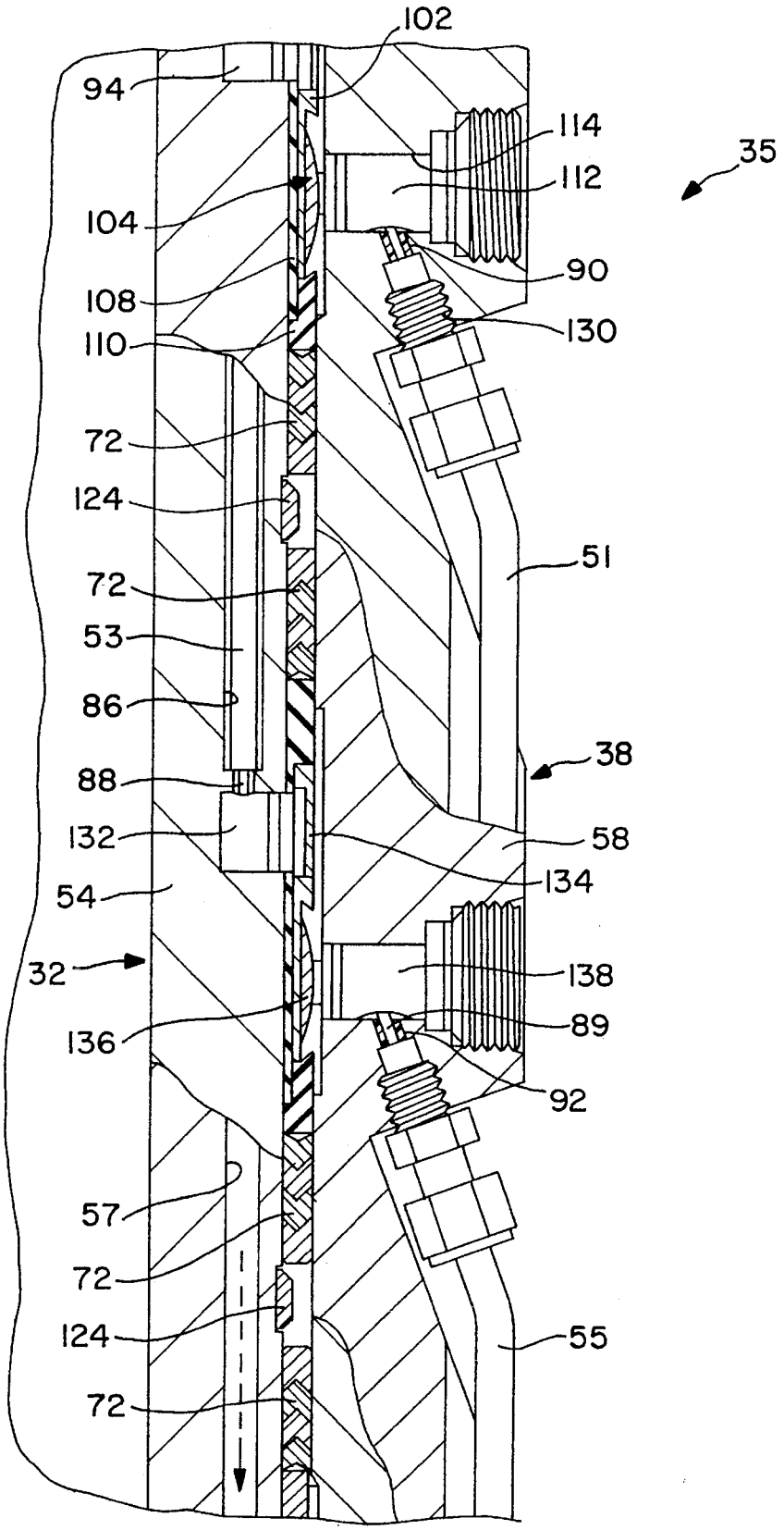
Figure 3C:
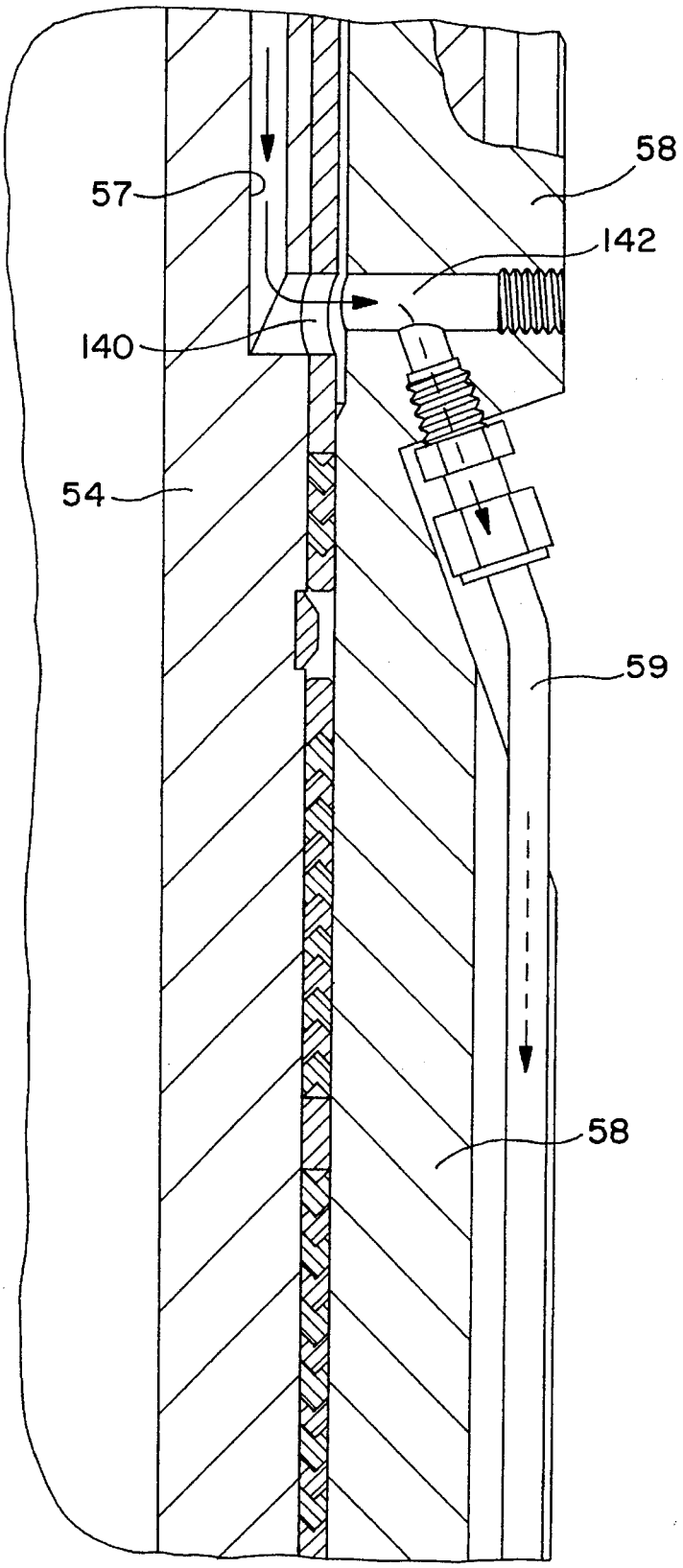
Figure 3D:
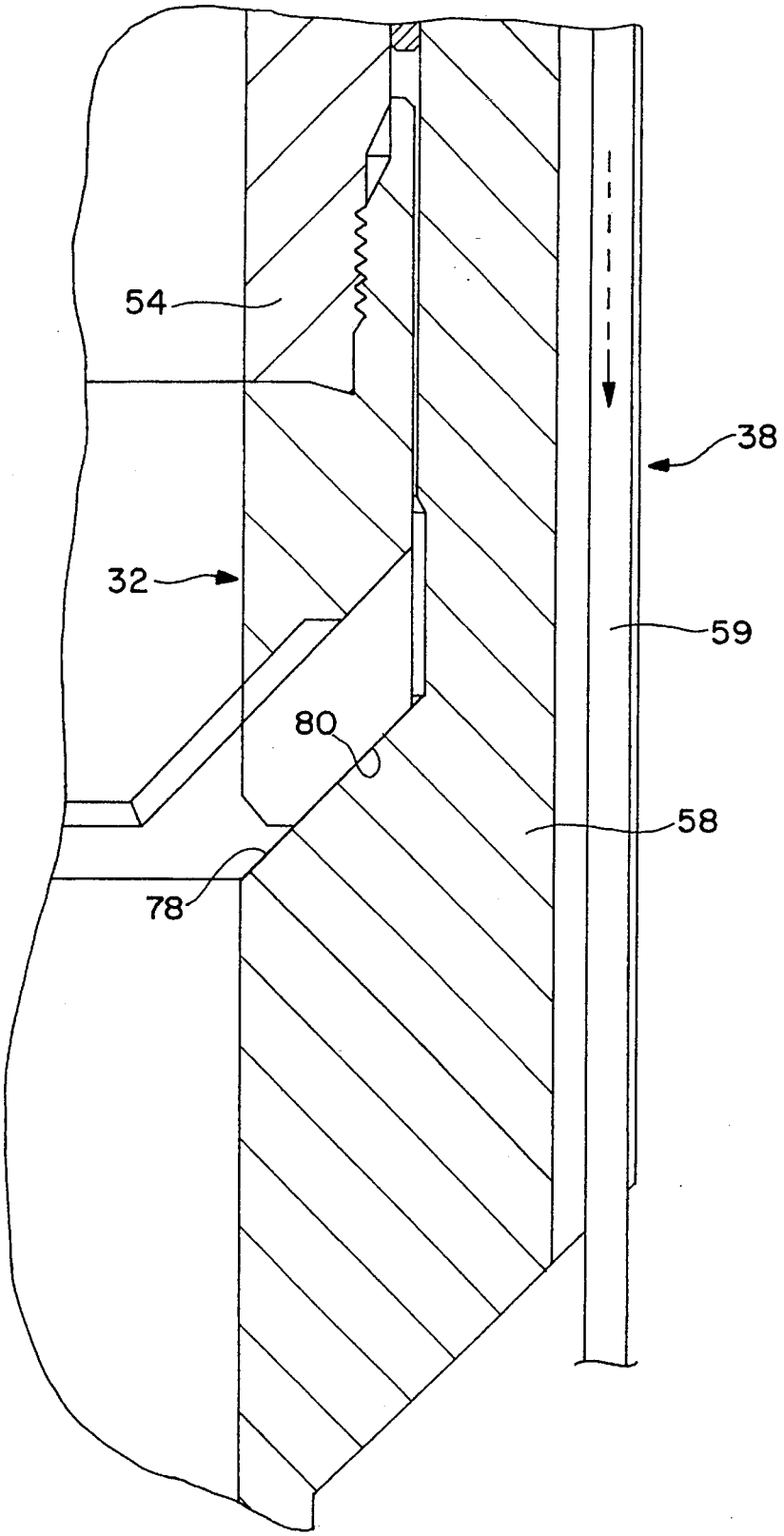

FIGS. 3A, 3B, 3C and 3D depict a wet connector system 35 in which wet connector seal unit 32 and concentric wet connector assembly 38 of the invention are shown in greater detail than in FIG. 2. Referring to FIG. 3A, wet connector seal unit 32 preferably comprises seal mandrel 54 having longitudinal bore 56, which is slidably disposed inside bore 60 of a smooth-bore tubular receptacle such as polished bore receptacle 58 of wet connector assembly 38. Chemical injection line 44 (seen in FIG. 2) is connected to seal mandrel 54 by a threaded connection at inlet port 62, and communicates through bore 45 drilled in seal mandrel 54 to connector port 64. Whenever seal mandrel 54 is fully seated inside polished bore receptacle 58 as shown in FIGS. 3A–3D, annular packing 72 disposed above and below connector port 64 limits fluid leakage that might otherwise occur between seal mandrel 54 and bore 60 of polished bore receptacle 58. Annular packing 72 is maintained in place by retainer member 73, which is also bored to permit fluid egress through connector port 64. Together, annular packing 72 and retainer member 73 provide means for restricting fluid flow between the annular flow channels of longitudinally spaced pairs of communicating connector ports and means for restricting fluid access to each annular channel between the first and second well tubulars. Whenever seal mandrel 54 is fully seated inside polished bore receptacle 58, connector port 64 is preferably disposed at substantially the same well depth as connector port 66 with which it is paired. Annular channel 74 between seal mandrel 54 and polished bore receptacle 58 provides fluid communication between connector port 64 and connector port 66 in polished bore receptacle 58 regardless of the rotational alignment between wet connector seal unit 32 and concentric wet connector assembly 38. The extent of the permissible deviation from horizontal alignment between connector port 64 and connector port 66 whenever seal mandrel 54 is fully seated in polished bore receptacle 58 will depend upon the width of annular channel 74. Fluid exiting connector port 64 is therefore primarily directed into connector port 66, blocked by plug 68, which communicates through threaded connector 70 with chemical injection line 47. It is therefore apparent from FIG. 3A that wet connector system 35 permits fluid communication to be established, interrupted and reestablished between chemical injection line 44 (through bore 45) and chemical injection line 47 simply by sequentially inserting, withdrawing and reinserting wet connector seal unit 32 into and out of concentric wet connector assembly 38 as desired. Referring to FIG. 3D, full engagement between wet connector seal unit 32 and concentric wet connector assembly 38 is achieved whenever shoulder 80 of seal mandrel 54 abuts against shoulder 78 of polished bore receptacle 58.

Figure 4:
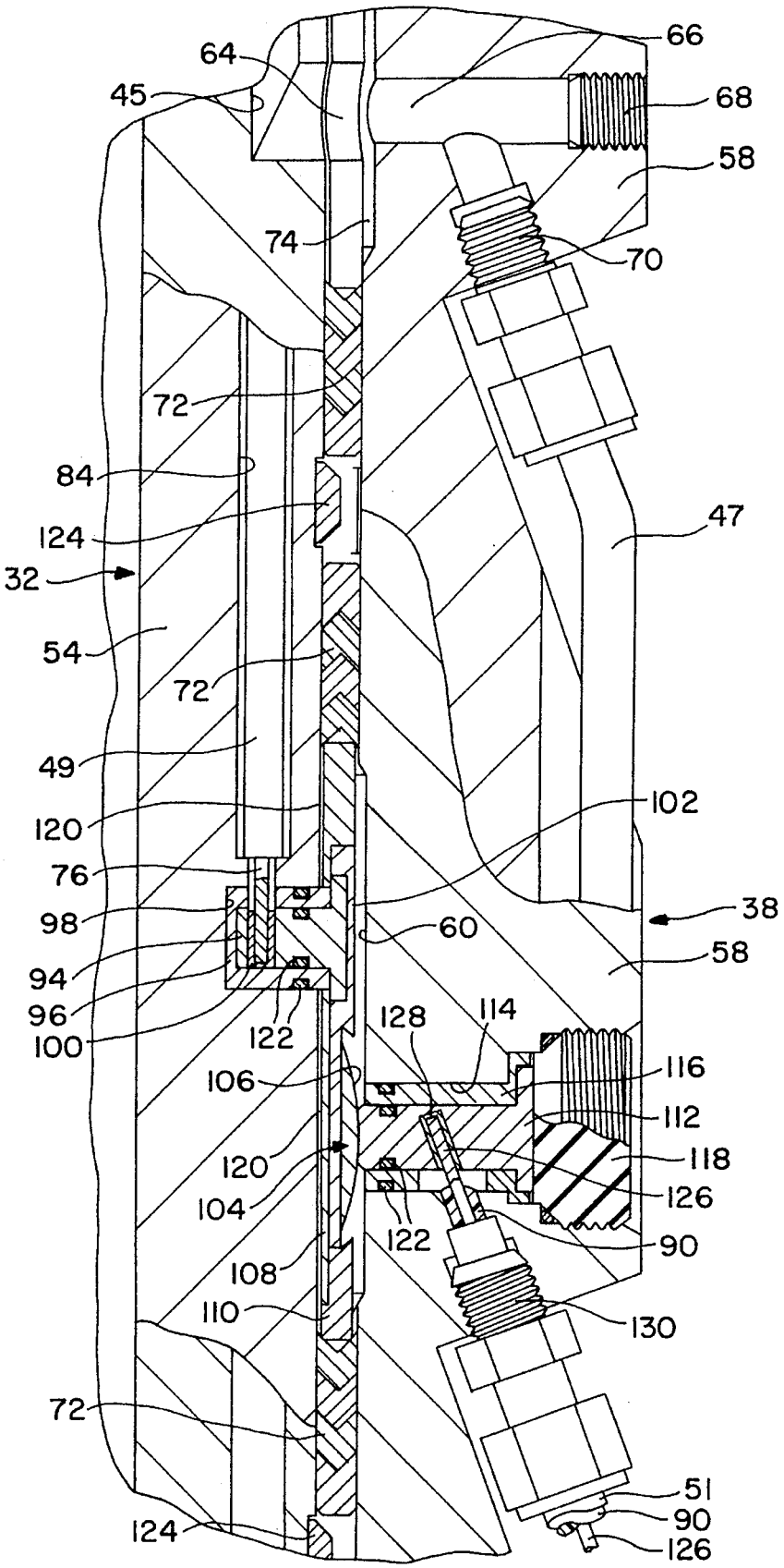
FIG. 4 is an enlarged sectional elevation view of one chemical injection line connector and one electrical control wire connector of the concentric wet connector assembly of the invention as shown in FIGS. 3A and 3B.

Referring to FIGS. 3A, 3B and 4, means are also provided as part of wet connector system 35 for making a selectively reversible electrical connection between insulated electrical wires 49, 53 of wet connector seal unit 32 and insulated electrical wires 90, 92, respectively, of concentric wet connector assembly 38. Above wet connector seal unit 32 (as shown in FIG. 2), electrical control line 46 is a conventional alloy steel control line containing insulated electrical wire 49. A similar electrical control line (not visible in FIG. 2, but disposed in a diametrically opposed position behind TRSV 30) contains insulated electrical wire 53, seen in FIG. 3B.

During fabrication of wet connector seal unit 32, the outer, small diameter conduit portion of electrical control line 46 (FIG. 2) is preferably terminated in a threaded fitting (not visible) that communicates with drilled bore 84 of seal mandrel 54. Referring to FIG. 4, insulated electrical wire 49, which runs through electrical control line 46, is cut to a length sufficient to extend down bore 84 and into electrically conductive button 94 seated inside electrically insulative material 96 in electrical connector port 98 of seal mandrel 54. About one inch of insulation is desirably removed from the end of electrical conductor 76, and electrical conductor 76 is inserted into an interference-fit electrical contact 100 in button 94. Button 94 is preferably silver-soldered to the underside of electrically conductive shell 102, which extends under electrically conductive louvered band 104.

Figure 5:
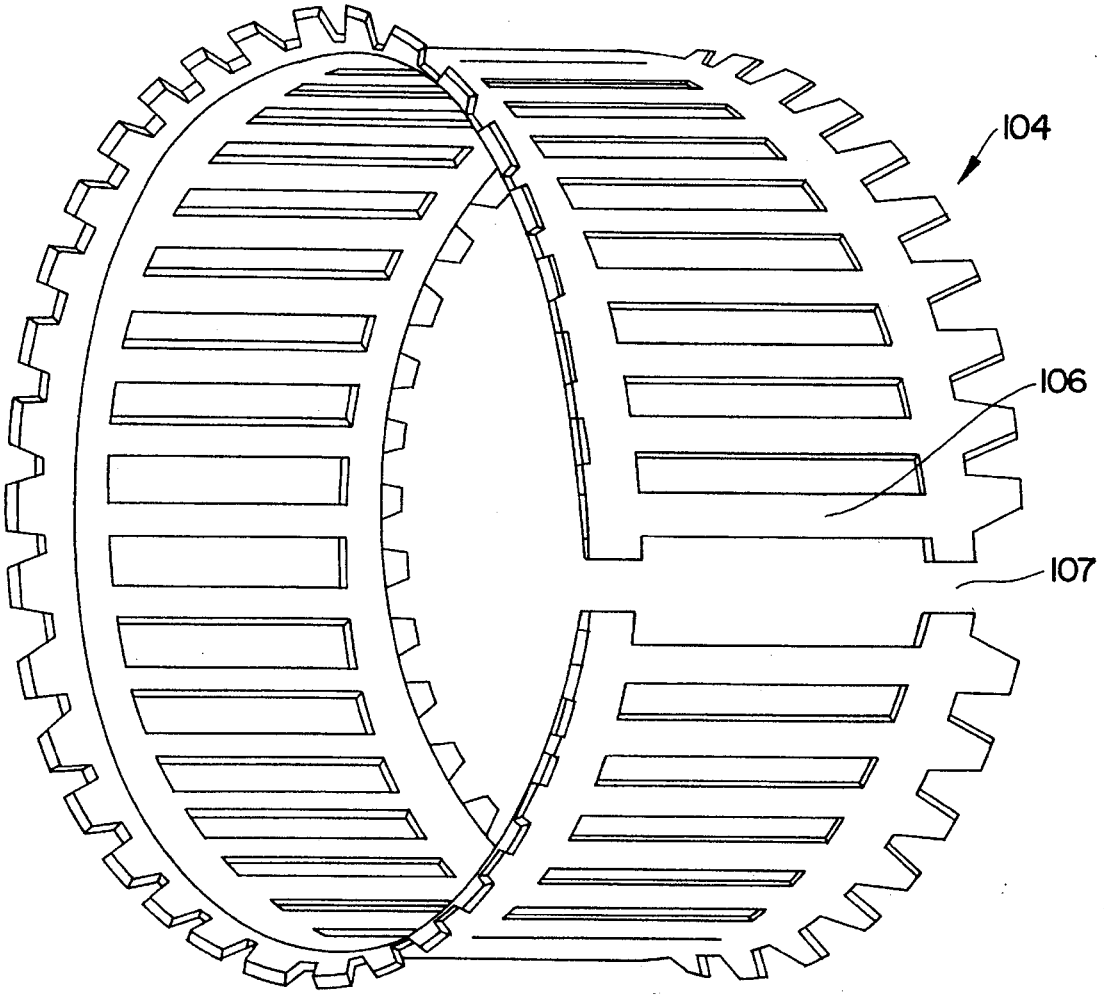
FIG. 5 is an enlarged perspective view of a knife-edged louvered band as shown in FIGS. 3B and 4.
Figure 6A:
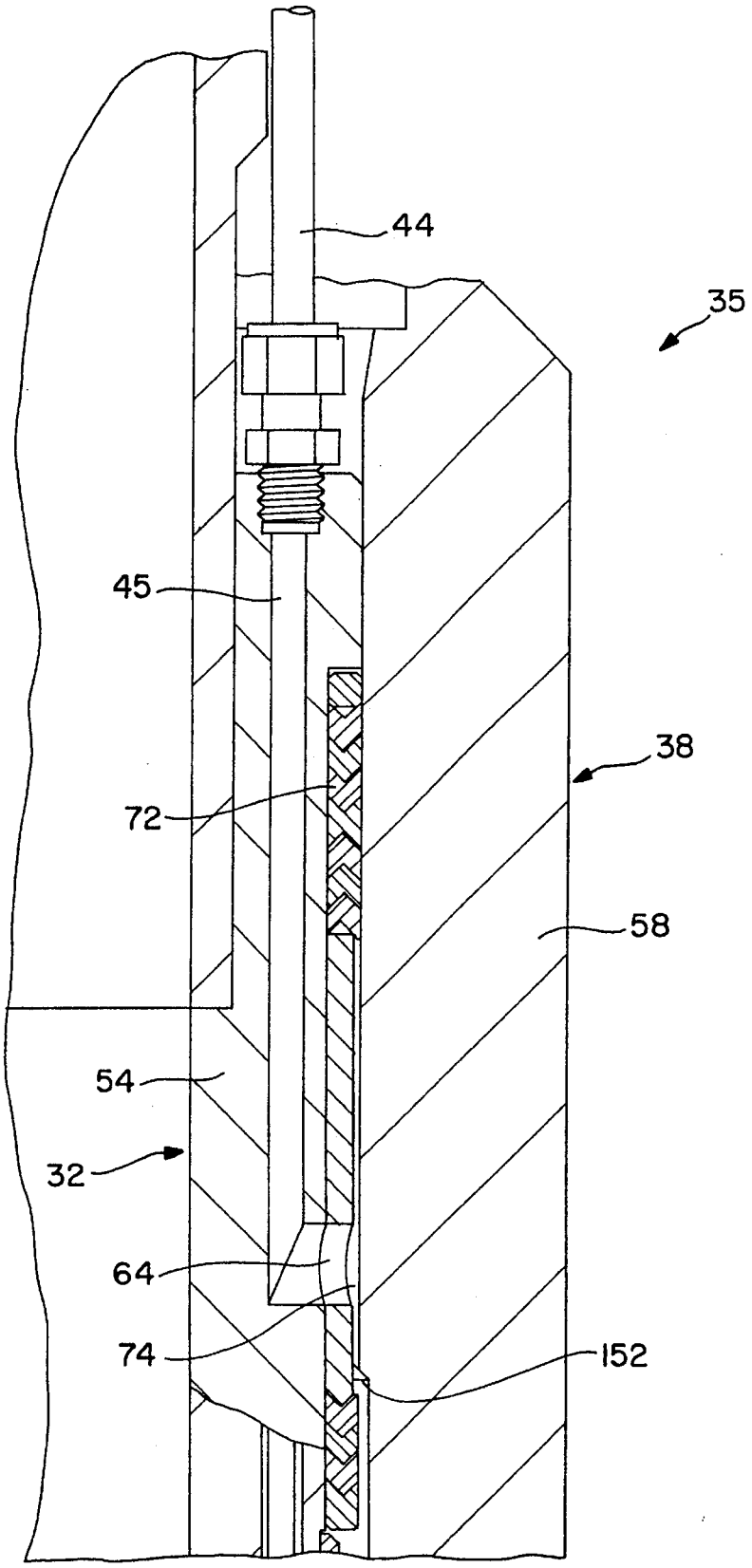
FIGS. 6A–6D, taken together, depict an enlarged elevation view, partially in section and partially broken away, of those portions of the wet connector system of FIGS. 3A–3D as they appear prior to full engagement, in the position where the fluid lines can be utilized to flush the connector ports and the annular spaces therebetween.
Figure 6B:
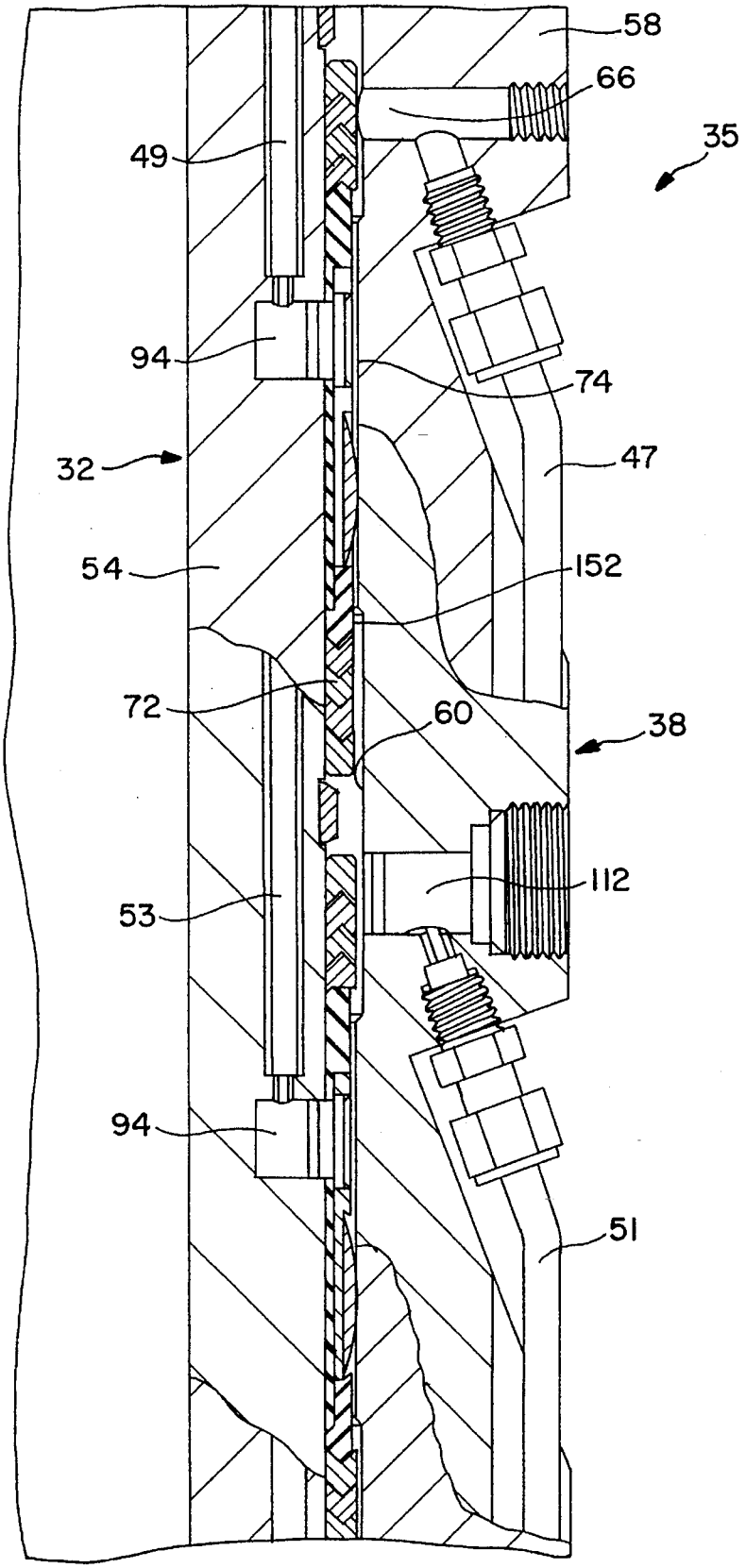
Figure 6C:
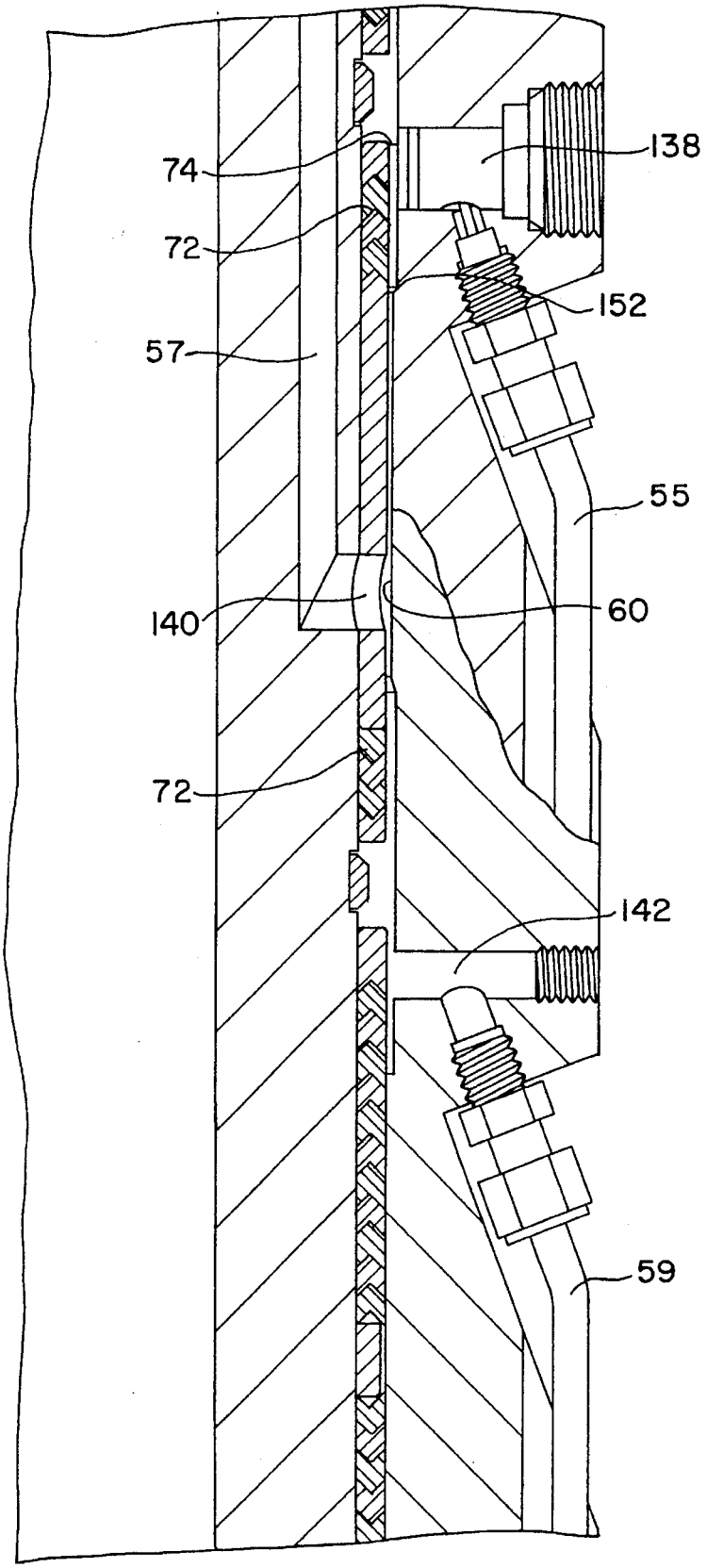
Figure 6D:
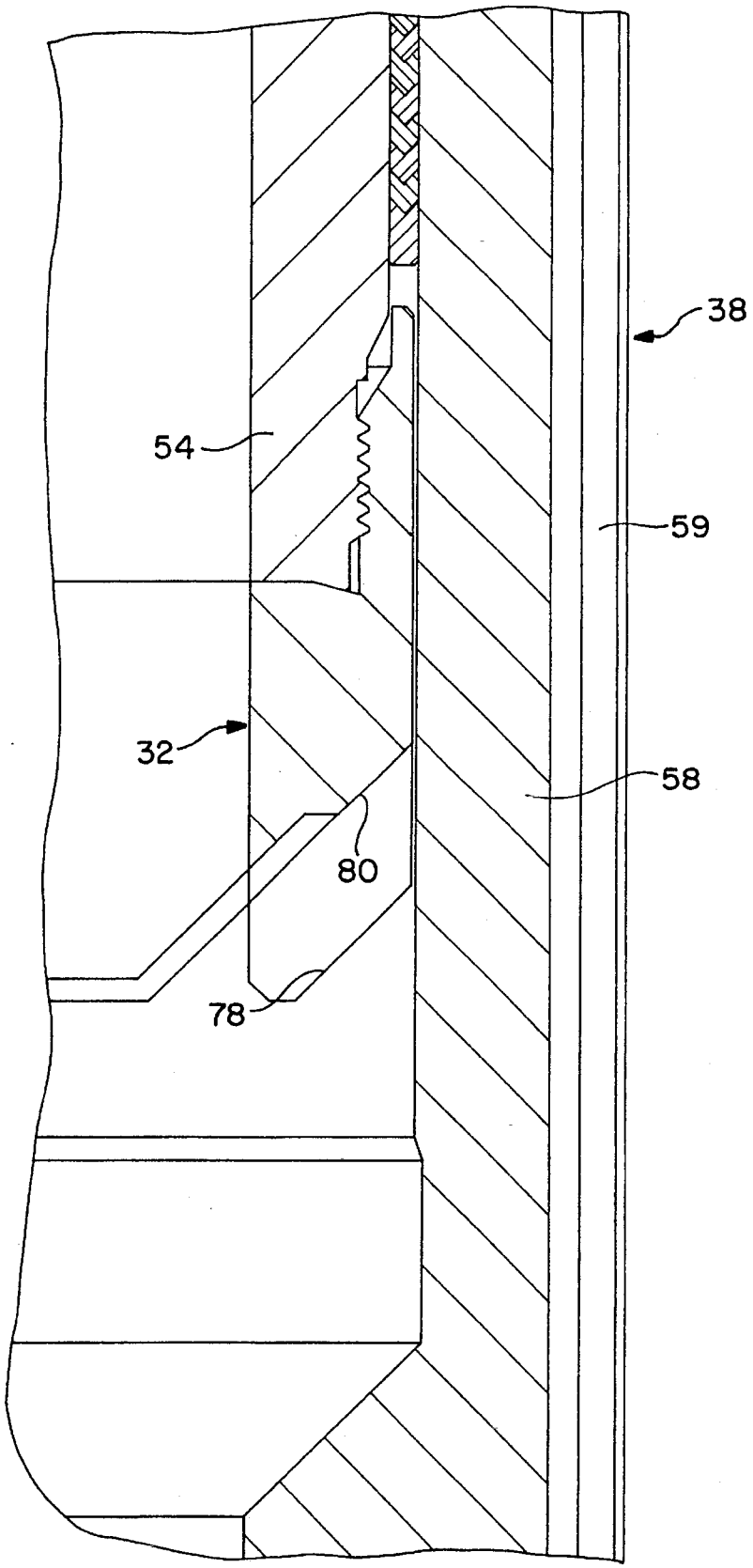

Referring to FIGS. 4 and 5, louvered band 104 is preferably a spring steel band having a plurality of longitudinally oriented, knife-edged contacts 106 extending circumferentially around seal mandrel 54. A narrow gap 107 (or a slight overlap in the ends of louvered band 104) is preferably provided to ensure substantially complete encirclement of seal mandrel 54 while simultaneously permitting louvered band 104 to establish contact between shell 102 and button 112. As seal mandrel 54 is lowered into full engagement with polished bore receptacle 58, knife-edged contacts 106 of louvered band 104 desirably deflect due to the tight interference fit and dig into both electrically conductive shell 102 and button 112, establishing high pressure, mating electrical contact between shell 102 and button 112. Because louvered band 104 extends around seal mandrel 54, electrical communication is established between button 94 and button 112 whenever seal mandrel 54 is fully seated inside polished bore receptacle 58 regardless of the rotational alignment therebetween. Button 94 and button 112 are preferably spaced apart both longitudinally and circumferentially from connector ports 64, 66, and from the other connector ports present in concentric wet connector system 35. The extent of the permissible deviation from horizontal alignment between button 94 and button 112 whenever seal mandrel 54 is fully seated in polished bore receptacle 58 will depend upon the length of shell 102.

During the make-up of concentric wet connector assembly 38 prior to installation in a well, electrical control line 51 is terminated at threaded fitting 130 in polished bore receptacle 58, and electrical wire 90 contained inside electrical control line 51 is desirably cut sufficiently long to extend into button 112. Insulation is stripped from the upper end of electrical conductor 126, and electrical conductor 126 is inserted into an electrically conductive, interference-fit contact 128 in button 112.

Electrically insulative members 108, 110, 116 and 118 are preferably provided to prevent grounding and electrical current leakage into seal mandrel 54 or polished bore receptacle 58. Preferred materials for use as the electrically insulative members which prevent current leakage around electrical connector ports 98, 114 are thermoplastic materials that are resistant to degradation in the presence of hydrocarbons at the temperatures and pressures likely to be encountered in the well. Optionally, additional protection against current leakage and corrosion can be provided around electrical connector ports 98, 114 by applying a thin, electrically insulative coating 120, such as a ceramic coating, to the outer surface of seal mandrel 54, and/or by applying a similar coating to the inside surface 60 of polished bore receptacle 58. This can be particularly important where the metal surfaces are contacted by an electrically conductive liquid such as salt water, which could otherwise create an electrolytic cell inside the concentric wet connector system of the invention.

As with connector ports 64, 66 previously described, packing 72 is desirably provided to limit fluid migration along the annulus between the longitudinally spaced connector ports. Retainer rings 124 are preferably provided to maintain the position of packing 72 on seal mandrel 54 during insertion, withdrawal, and use. O-rings 122 are also preferably disposed around buttons 94, 112 to provide pressure seals, which can be particularly important if wet connector system 35 of the invention is to be used in an environment where there is considerable hydraulic or hydrostatic pressure.

Referring again to FIGS. 3A, 3B and 3C, electrical conductor 88 in electrical wire 53 disposed in bore 86 of seal mandrel 54 is similarly connected to electrical conductor 89 in electrical wire 92 disposed in electrical control line 55 attached to polished bore receptacle 58 by means of button 132, shell 134, louvered band 136 and button 138 in the manner described above. In like manner, connector port 140 in seal mandrel 54 and connector port 142 in polished bore receptacle 58 provide fluid communication between bore 57 and chemical injection line 59 as described above in relation to connector ports 64, 66.

Figure 7:
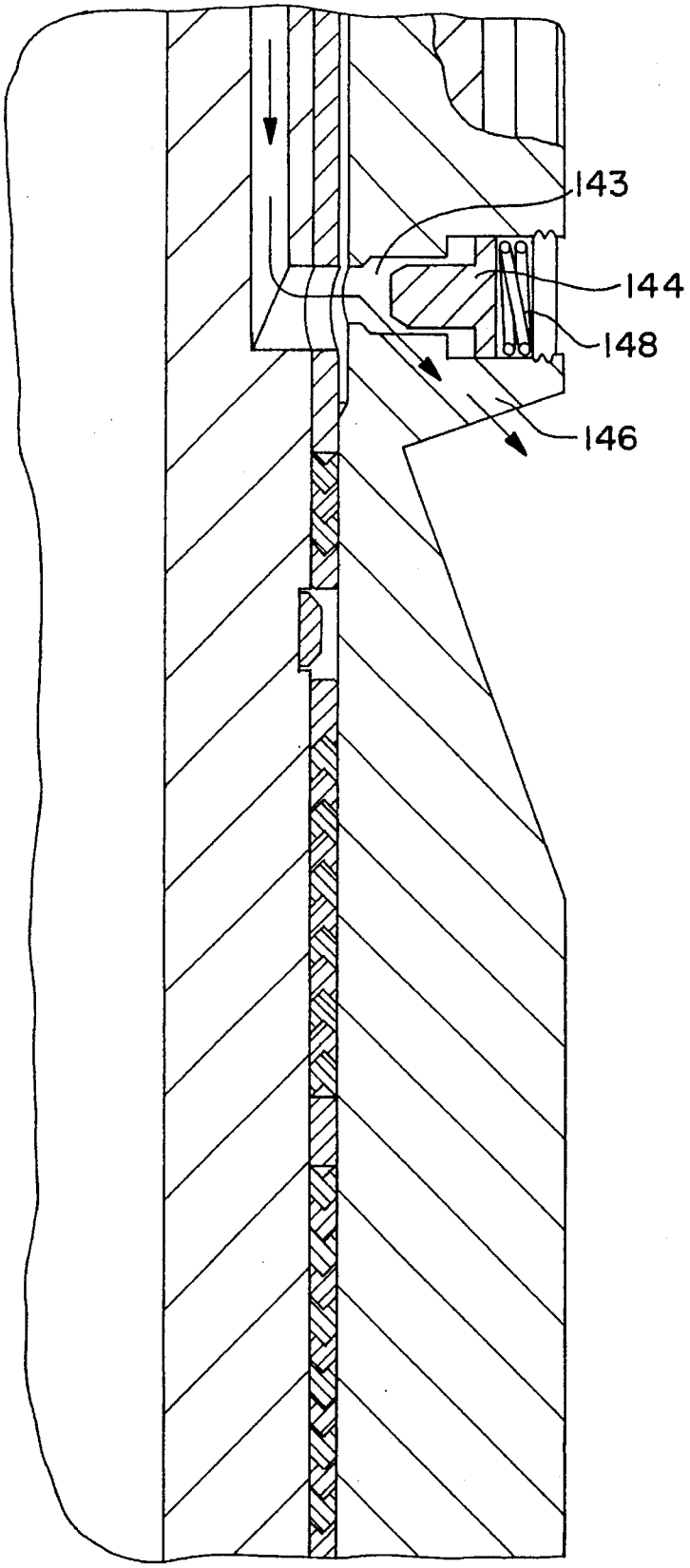
FIG. 7 is a cross-sectional detail elevation view of an alternative embodiment of the connector system of the invention in which the connector port in one of the well tubulars communicates directly with an end use device rather than with another auxiliary conduit.
Figure 8:
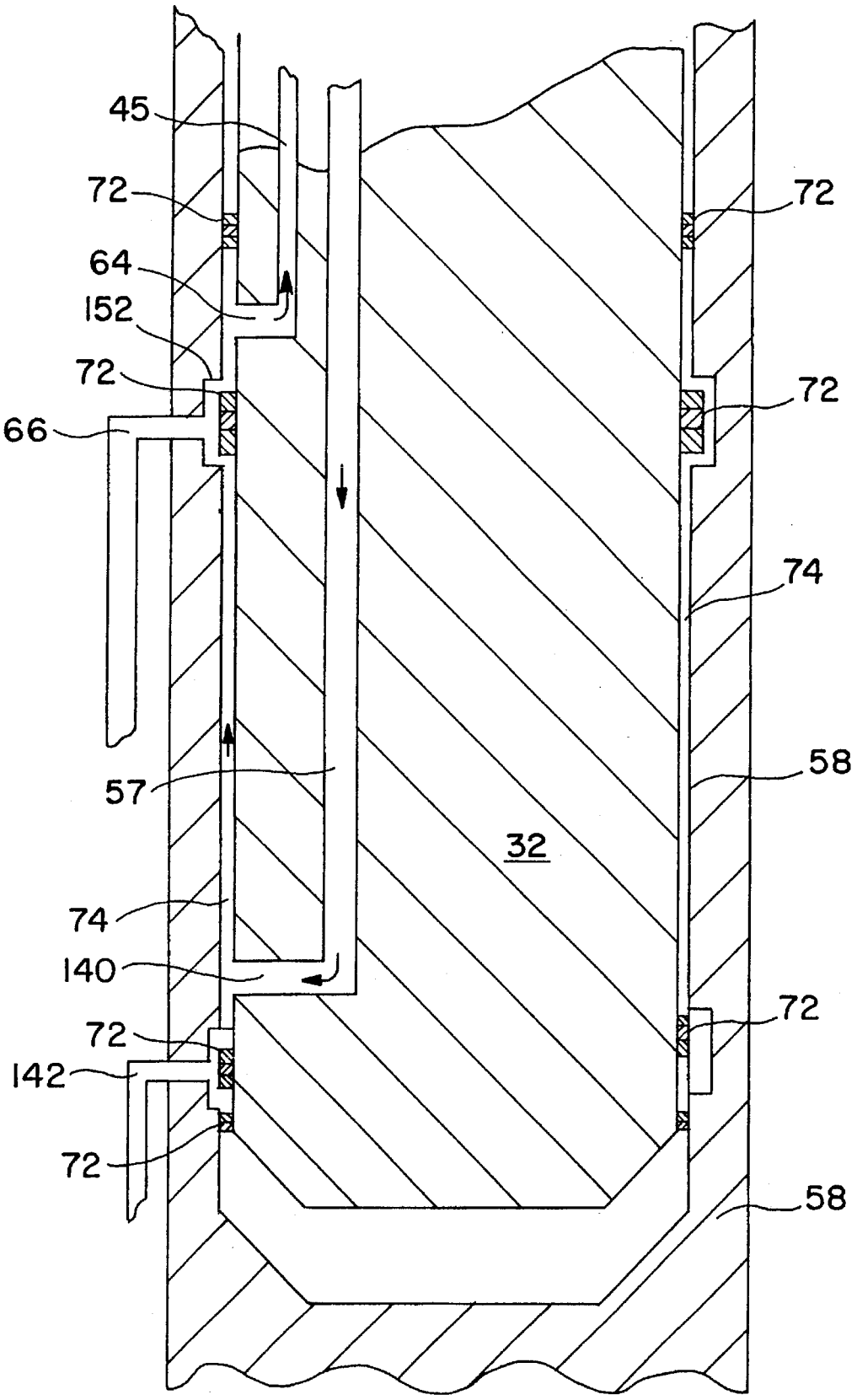
FIG. 8 is a schematic view of those portions of the wet connector of FIGS. 6A–6D as they appear prior to full engagement, in the position where the fluid lines can be utilized to flush the connector ports and the annular space therebetween.

In accordance with another embodiment of the invention, as shown in FIG. 7, it is not always required that the receiving port (such as connector port 142 in FIG. 3C) communicate with another small diameter conduit. Thus, for example, in some cases it may be desirable for a receiving port such as connector port 143 to communicate directly with an end use device such as spring operated valve 144 in FIG. 7, which discharges fluid through outlet 146 whenever spring 148 is overpressured. Upon reading this disclosure, it will be apparent that the connector system of the invention can be similarly used to establish direct fluid or electrical communication with other fluid or electrically actuated end use devices situated substantially adjacent to the receiving connector port without the need for another small diameter conduit.

While the electrical connector means disclosed herein for use in the present invention are discussed primarily in the context of low amperage usage, it will be appreciated upon reading this disclosure that the structural elements of the invention are similarly applicable to moderate or high amperage usages such as electrically operated safety valves, power transmission to electric submersible pumps, and the like. Also, while the structure and operation of the invention are described herein according to a preferred embodiment wherein the male portion of the subject wet connector system is lowered into the female portion, it will become apparent upon reading the disclosure that similarly useful concentric connector systems can be made by reversing the orientation of the male and female elements of the invention.

Referring to FIGS. 6A–6D and FIG. 8, according to another aspect of the present invention, means are desirably provided for pumping a clean dielectric fluid such as silicone fluid through bores 45 and 57 of seal mandrel 54, bores 45 and 57 being connected to a first auxiliary conduit and a second auxiliary conduit, to flush or purge contaminants from the respective connector ports, the same being referred to as first and second paired connector ports, of wet connector system 35 prior to fully seating seal mandrel 54 of wet connector seal unit 32 inside polished bore receptacle 58 of concentric wet connector assembly 38. Conventional shearable means can be installed in wet connector system 35 to provide a positive indication to an operator at the surface whenever seal mandrel 54 has been lowered into polished bore receptacle 58 a sufficient distance that purging can be initiated. One such shear means is a shear collar 150 as shown (partially broken away) in FIG. 2. The shearable means will desirably arrest the insertion of seal mandrel 54 into polished bore receptacle 58 at a point where lower shoulder 80 of seal mandrel 54 has not yet abutted against shoulder 78 of polished bore receptacle 58. When this occurs, packing 72 on seal mandrel 54 is preferably situated at a point relative to slight recesses 152 in bore 60 of polished bore receptacle 58 where annular channel 74 between seal mandrel 54 and polished bore receptacle 58 extends continuously between connector port 64 and connector port 140, permitting fluid to be circulated through those ports and the other connector ports disposed therebetween. In this way, the annular channel provides fluid communication between the first and second paired connector ports thereby permitting flushing of contaminants from the ports. When the connector ports have been purged to the desired extent, seal mandrel 54 can be fully seated in polished bore receptacle 58 by overpressuring the shearable means such as shear ring 150 from the surface.

Although the means for fluidly flushing contaminants from selected connector ports as described above is preferably accomplished by using two longitudinally spaced fluid ports in the concentric wet connector system of the invention, where only one fluid port is present, purging can also be accomplished by injecting the dielectric fluid through the single fluid port. Where only one fluid port is used, it is preferably situated above any other port that is to be purged. When a single injection port is used, rather than recirculating the fluid to the surface, it is preferably just discharged into the well bore.

Other alterations and modifications of the invention will likewise become apparent to those of ordinary skill in the art upon reading the present disclosure, and it is intended that the scope of the invention disclosed herein be limited only by the broadest interpretation of the appended claims to which the inventors are legally entitled.

We claim:

1. A connector system for auxiliary conduits attached to well tubulars disposed downhole in oil and gas wells, said system comprising:

first and second slidably engageable well tubulars defining a coaxially longitudinal bore, each well tubular having a circumferentially extending wall section, each well tubular containing at least a first and second connector port, spaced longitudinally apart, said ports being positioned in said first and second well tubulars so that when said well tubulars are engaged to a predetermined extent, said first port of said first well tubular is operably connected to said first port of said second well tubular, and said second port of said first well tubular is operably connected to said second port of said second well tubular; said first port of said first well tubular and said first port of said second well tubular constituting a first pair of connector ports, and said second port of said first well tubular and said second port of said second well tubular constituting a second pair of connector ports, said first pair of connector ports and said second pair of connector ports being spaced longitudinally apart;

means of operably connecting said first connector port of said first well tubular and said first connector port of said second well tubular whenever said first and said second well tubulars are slidably engaged to a predetermined extent, said means for operably connecting said first pair of connector ports, functioning without regard to the rotational alignment between said first and second slidably engageable well tubulars;

means of operably connecting said second connector port of said first well tubular and said second connector port of said second well tubular whenever said first and said second well tubulars are slidably engaged to a predetermined extent, said means of operably connecting said second pair of connector ports functioning without regard to the rotational alignment between said first and second slidably engageable well tubulars;

a channel formed by the walls of said first and second well tubular, said channel extending between said first and said second connector ports of said first well tubular, said channel allowing fluid communication between said first and second connector ports of said first well tubular, said channel being open only when said first and second slidably engageable well tubulars are not fully engaged, said channel thereby permitting flushing of contaminants from said connector ports prior to said well tubulars being fully engaged by transmission of a flushing fluid through said first connector port of said first well tubular, through said channel, and then through said second connector port of said first well tubular, and further wherein when said tubular members are completely engaged, said channel no longer allows fluid communication between said first connector port of said first well tubular and said second connector port of said first well tubular.

2. The connector system of claim 1 further comprising:

a first auxiliary conduit in fluid communication with said first connector port of said first well tubular; and a second auxiliary conduit in fluid communication with said second connector port of said first well tubular;

wherein said flushing of contaminants may be accomplished by transmission of flushing fluid through said first auxiliary conduit, through said first connector port of said first well tubular, through said channel, through said second connector port of said first well tubular, and then through said second auxiliary conduit.

3. The connector system of claim 1 wherein at least one of said paired connector ports comprises means of establishing fluid communication therebetween.

4. The connector system of claim 1 wherein at least one of said paired connector ports comprises means for establishing electrical communication therebetween.

5. The connector system of claim 1 wherein at least one of said paired connector ports comprises means of establishing fluid communication therebetween and at least one of said paired connector ports comprises means of reestablishing electrical communication therebetween.

6. The connector system of claim 3 wherein each means for establishing fluid communication therebetween comprises another separate annular flow channel between the first and second well tubulars.

7. The connector system of claim 4 wherein each means for establishing electrical communication therebetween comprises an annular space between the first and second well tubulars and an electrically conductive band disposed in the annular space.

8. The connector system of claim 4 wherein each means for establishing electrical communication therebetween is isolated from the first and second well tubulars by electrically insulative material.

9. The connector system of claim 5 wherein the means for establishing electrical communication therebetween is isolated from the first and second well tubulars by electrically insulative material.

10. The connector system of claim 6, further comprising means for restricting fluid flow between the annular flow channels of longitudinally spaced pairs of communicating connector ports.

11. The connector system of claim 7, further comprising means for restricting fluid access to each annular space between the first and second well tubulars.

12. The connector system of claim 4 wherein the means for establishing electrical communication therebetween comprises a first electrical conductor extending through a first auxiliary conduit to a connector port in the first well tubular, a second electrical conductor extending through a second auxiliary conduit to a complementary connector port in the second well tubular, an electrically conductive annular band providing interfering contact between the first and second well tubulars, and electrically conductive means for connecting the annular band to the first and second electrical conductors through the complementary pair of connector ports.

13. A disconnectable connector system for auxiliary conduits attached to well tubulars disposed below an annular safety valve and a production packer in an oil and gas well, said system comprising:

a smooth bore receptacle disposed inside a casing in the well and a wet connector seal unit suspended from production tubing and adapted to slidably engage said smooth bore receptacle to a predetermined extent, said slidably engaged wet connector seal unit and said smooth bore receptacle cooperating to define a coaxial, longitudinally extending bore;

said wet connector seal unit and said smooth bore receptacle each comprising a plurality of longitudinally spaced connector ports, each of said connector ports in said wet seal connector unit being paired, complementary with, and communicating with one each of said connector ports in said smooth bore receptacle when said wet connector seal unit and said smooth bore receptacle are engaged to said predetermined extent;

means of establishing communication between each of said connector ports of said slidably engaged wet connector seal unit and each of said complementary paired connector ports of said smooth bore receptacle without regard to the rotational alignment between said wet connector seal unit and said smooth bore receptacle;

a channel formed by the walls of said wet connector seal unit and said smooth bore receptacle, said channel extending between at least a first and a second connector port of said wet connector seal unit, said channel allowing fluid communication between said first and second connector ports of said wet connector seal unit, said channel being open only when said wet connector seal unit and said smooth bore receptacle are not fully engaged, said channel thereby permitting flushing of contaminants from said connector ports prior to said wet connector seal unit and said smooth bore receptacle being fully engaged by transmission of a flushing fluid through said first connector port of said wet connector seal unit, through said channel, and then through said second connector port of said wet connector seal unit, and further wherein when said wet connector seal unit and said smooth bore receptacle are completely engaged, said channel is no longer in communication with any of said connector ports;

a first auxiliary conduit in fluid communication with the first connector port of said wet connector seal unit;

a second auxiliary conduit in fluid communication with the second connector port of said wet connector seal unit;

wherein said flushing of contaminants may be accomplished by transmission of flushing fluid through said first auxiliary conduit, through said first connector port of said wet connector seal unit, through said channel, through said second connector port of said wet seal connector unit, and then through said second auxiliary conduit.

14. The connector system of claim 13 wherein at least one of said pairs of communicating connector ports comprises means for establishing electrical communication therebetween.

15. The connector system of claim 13 wherein at least one of said pairs of communicating connector ports comprises means for establishing fluid communication therebetween and at least one of said pairs of communicating connector ports comprises means for establishing electrical communication therebetween.

16. The connector system of claim 15 wherein each means for establishing fluid communication therebetween comprises another separate annular flow channel between the wet connector seal unit and the smooth bore receptacle.

17. The connector system of claim 15 wherein the means for establishing electrical communication therebetween comprises an annular space between the wet connector seal unit and the smooth bore receptacle, and an electrically conductive band disposed in the annular space.

18. The connector system of claim 14 wherein the means for establishing electrical communication therebetween comprises a first electrical conductor extending through a first auxiliary conduit to a first connector port in the wet connector seal unit, a second electrical conductor extending through a second auxiliary conduit to a second connector port in the smooth bore receptacle, an electrically conductive annular band providing interfering contact between the wet connector seal unit and smooth bore receptacle, and electrically conductive means for connecting the annular band to the first and second electrical conductors through the first and second connector ports.

* * * * *